United States Patent [19]

Delli-Gatti, Jr.

[11] 4,172,616

[45] Oct. 30, 1979

[54] CUTTING HEAD WITH SELF-CONTAINED POWER SOURCE

[75] Inventor: Frank A. Delli-Gatti, Jr., Beckley, W. Va.

[73] Assignee: Coaltex, Inc., Beckley, W. Va.

[21] Appl. No.: 873,970

[22] Filed: Jan. 31, 1978

[51] Int. Cl.[2] ..... E21C 27/24

[52] U.S. Cl. ..... 299/80; 175/106; 299/82; 299/89

[58] Field of Search ..... 299/76, 78, 85, 86, 299/89, 80, 82–84; 175/91, 106

[56] References Cited

U.S. PATENT DOCUMENTS

| | | | |
|---|---|---|---|
| 3,288,536 | 11/1966 | Galis et al. | 299/64 |
| 3,290,096 | 12/1966 | Stalker | 299/78 |
| 3,894,587 | 7/1975 | Source | 175/91 |
| 4,047,763 | 9/1977 | Gilliland et al. | 299/76 |

FOREIGN PATENT DOCUMENTS

| | | | |
|---|---|---|---|
| 1095559 | 12/1967 | United Kingdom | 299/89 |
| 920300 | 9/1966 | U.S.S.R. | 299/80 |

*Primary Examiner*—Ernest R. Purser

*Attorney, Agent, or Firm*—Cushman, Darby & Cushman

[57] ABSTRACT

A cutting drum for a mining machine that requires only a single supporting arm, and single interior motor for rotation of the cutting drum. The drum has two body portions which are spaced apart a distance sufficient to receive the supporting arm along the axis of the drum. A cutting chain is operatively connected by sprocket teeth to each of the body portions, one of the body portions being driven by a shaft of the interior motor through reduction planetary gears. Only a single stage reduction need be provided. One of the body portions may be formed so that it is longitudinally reciprocal along the axis of the drum to vary the cutting height or width.

23 Claims, 4 Drawing Figures

CUTTING HEAD WITH SELF-CONTAINED POWER SOURCE

BACKGROUND OF THE INVENTION

For mining machines in general, and particularly for coal mining machines such as shown in U.S. Pat. No. 4,037,875 and for conventional continuous mining machines (see U.S. Pat. No. 4,047,763), it has been found desirable to provide the power source for rotating the cutting head completely within the confines of the cutting head. For instance, in U.S. Pat. No. 4,047,763 there is disclosed a mining head having a single support with a pair of cutting drums, one on either side of the support, and a separate power source for each of the cutting drums contained completely within each cutting drum, and a dual-stage planetary gear reduction means for transferring rotation of the motor shaft into rotation of the cutting drum. A cutting chain covers the support between the two cutting drums, only small radially outwardly extending portions of the supporting arm being provided, comprising the only non-rotating exterior portion of the cutting head. U.S. Pat. Nos. 3,290,096 and 3,288,536 disclose other prior art cutting heads having internal power sources. Both of these cutter heads include a pair of supporting arms with a single power source disposed between the arms for rotation of the cutting surfaces. In U.S. Pat. No. 3,290,096 the internal power source rotates in the opposite direction as the cutting drum, and connecting components are provided extending between a middle cutting drum portion and two exterior cutting drum portions on either side of the dual supports. Dual planetary gear reduction means are provided, and two non-rotating external exterior sufaces exist. U.S. Pat. No. 3,288,536 utilizes opposed windings on relatively rotatable parts interior of a cutting head shaft extending the entire length of the cutting head, with gearing connections to a plurality of surrounding cutter shafts, the gearing speeding up rotation of the cutter shafts compared to the central power source shaft.

While the prior art cutting heads with internal drive sources are generally useful, there has heretofore not been provided a cutting head with internal drive which requires only one supporting arm and only one motor for rotation of the drum and presents rotating cutting portions along the entire length of the cutting exterior thereof. Such a structure has been provided according to the present invention, however.

According to the present invention, a generally cylindrical drum for a mining machine or the like is provided. The cutting drum includes first and second generally cylindrical body portions spaced from each other along the longitudinal axis of the drum cylinder, each of the body portions having cutting projections formed on the exterior surfaces thereof. The power source is contained completely within the cylinder of the cutting drum and rotates the first body portion. Means are provided for effecting rotation of the second body portion upon rotation of the first body portion, said means including a cutting chain in operative association with both the body portions and operatively bridging the space therebetween.

Viewed in another manner, according to the present invention a cutting drum for a mining machine or the like is provided which comprises a generally cylindrical cutting surface having cutting projections formed thereon and having an axis of the cylinder and a pair of cylinder end faces. A single supporting arm for supporting the cutting drum extends perpendicular to the axis of the cutting surface intermediate the end faces thereof. A power source for effecting rotation of the cylinder cutting surface about the axis comprises a single motor disposed within the volume defined by the cylindrical cutting surface and a motor shaft, the motor having portions thereof extending axially on either side of the single supporting arm. Gear reduction means are provided for transferring rotation of the motor shaft into rotation of the cutting surface, the gear reduction means operatively connected to an interior portion of the cutting surface and to the motor shaft.

The cutting drum according to the present invention may be utilized with any type of mining machine but finds particular suitability in use with full face miners such as shown in U.S. Pat. No. 4,037,875, the disclosure of which is hereby incorporated by reference in the subject application. When utilized with a full face miner, it is desirable to have a capability of the cutting head of extending a portion of the cutting surface longitudinally along the axis of the drum to increase the possible effective cutting height of the drum.

Also according to the present invention, it is possible to achieve the necessary gear reduction with only a single stage planetary reduction gear means. The planetary reduction gear means includes a sun gear formed on the motor shaft, a planet carrier having three planetary gears mounted thereon, and a stationary ring housing concentric with the cutting surface and with gear means formed on the interior of the ring housing, the planetary gears being in operative association with the sun gear and the ring housing gear means. The planetary gears are relatively large compared to the sun gears so that the sun gear has gear surfaces of the planetary gears disposed adjacent thereto substantially around the entire 360° circumference thereof.

It is the primary object of the present invention to provide a useful cutting head for a mining machine, the cutting head having a self-contained power source. This and other objects of the invention will become clear from an inspection of the detailed description of the invention, and from the appended claims.

DETAILED DESCRIPTION OF THE INVENTION

Figure 1:
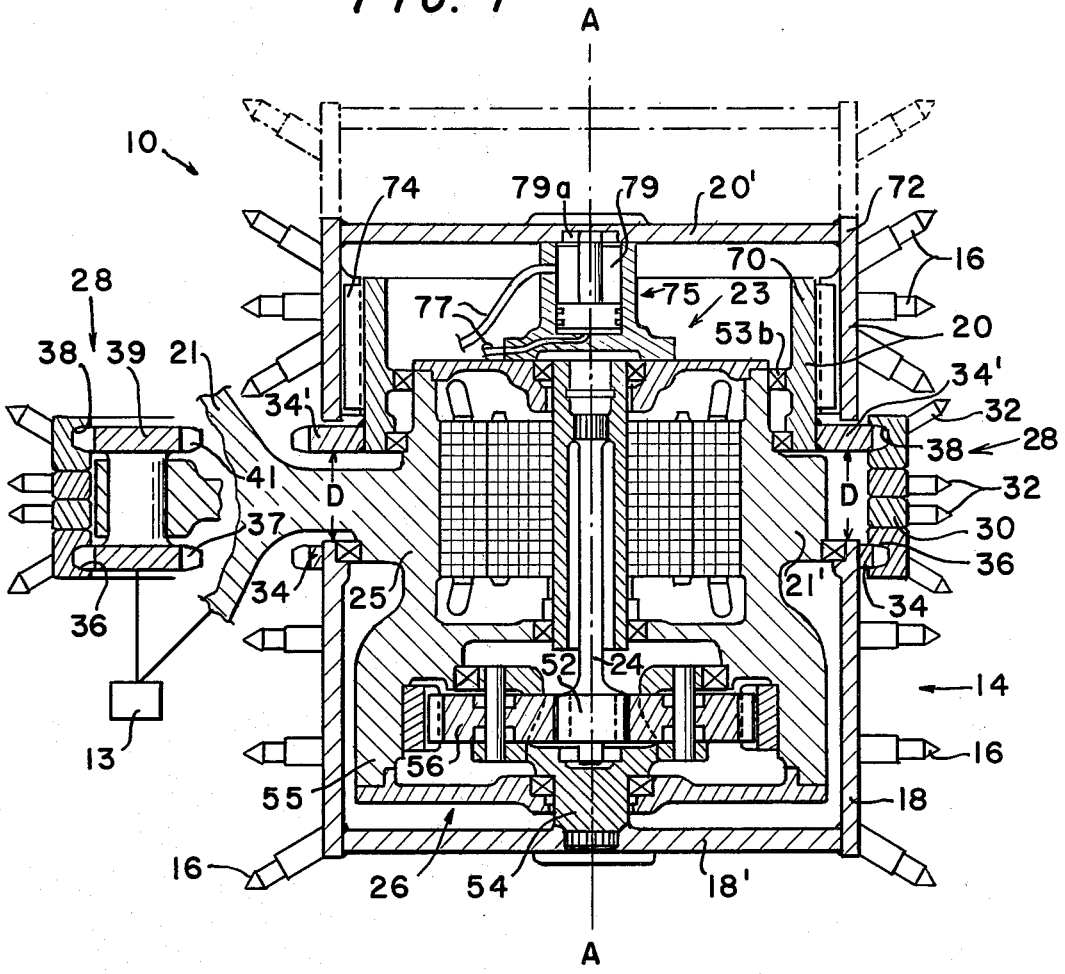
FIG. 1 is a schematic side view of an exemplary cutting drum assembly according to the invention.
Figure 2:
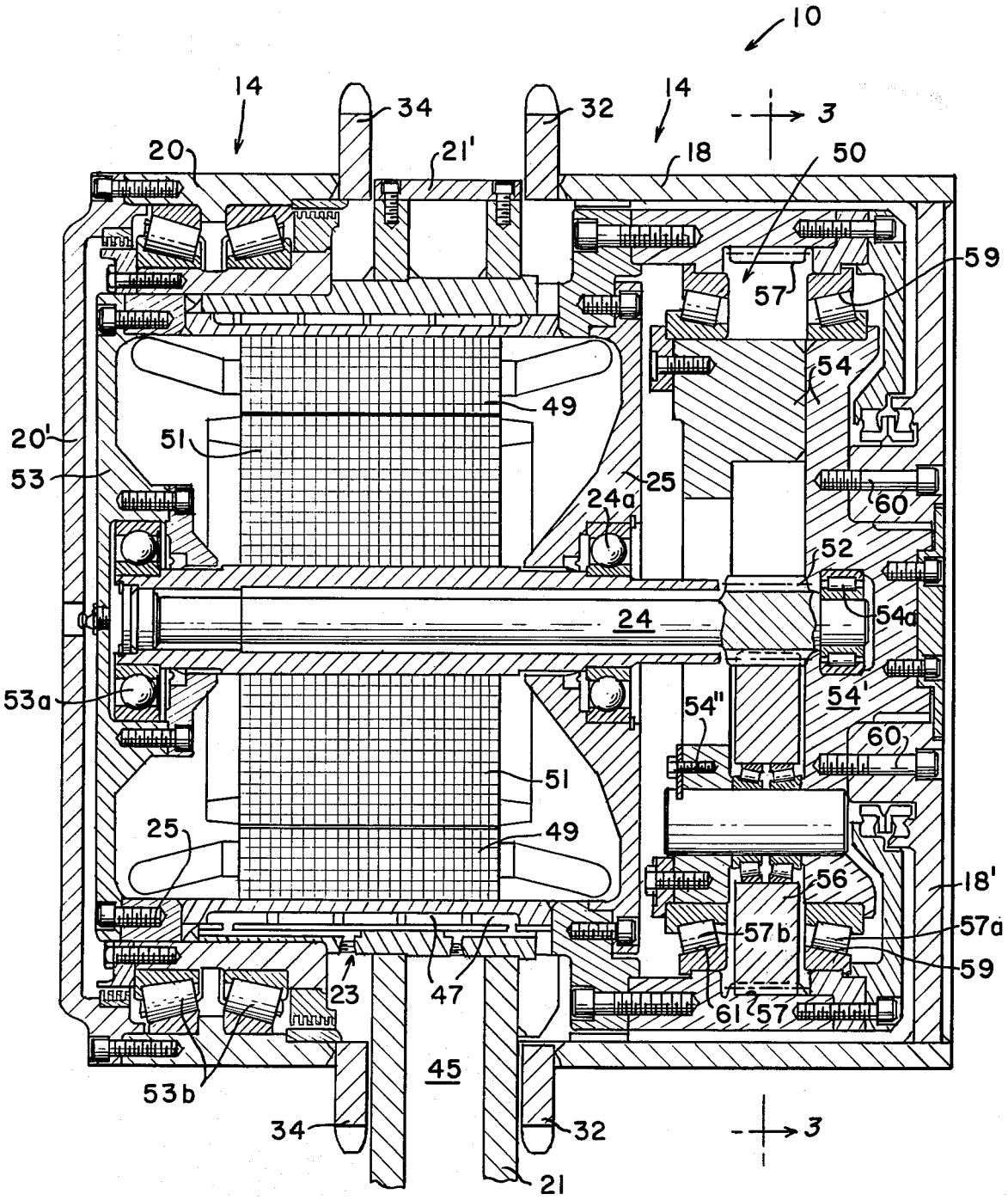
FIG. 2 is a cross-sectional view of an exemplary cutting drum according to the invention taken along lines 2—2 of FIG. 3.

An exemplary cutting drum for a mining machine according to the present invention is shown for a first embodiment in FIG. 1, and another embodiment in FIG. 2. With reference to the drawings, for clarity all rotatable components have been given an even reference numeral, all non-rotatable components have been given an odd reference numeral, and all bearings between relatively rotatable components have been given a reference numeral with a letter suffix. The cutting head illustrated in the drawings is especially adapted for use with the mining machine shown in U.S. Pat. No. 4,037,875 (the disclosure of which is hereby incorporated by reference in the present application) wherein the head is mounted for rotation about a vertical axis A—A and is longitudinally reciprocal along the mine face, however the cutting head according to the invention is not restricted to full face miners but is also utilizable in conventional continuous miners and other like mining machines.

A generally cylindrical cutting drum according to the present invention is shown generally at 10 in FIGS. 1 and 2, the drum 10 associated with a conventional mining machine, shown only schematically at 13 in FIG. 1. The drum 10 comprises a generally cylindrical cutting surface 14 having a plurality of conventional cutting projections 16 formed along the length and arounf the periphery thereof, the cutting surface 14 including first and second generally cylindrical body portions 18,20 spaced from each other along the longitudinal axis A—A of the drum cylinder 10 a distance D. A supporting arm 21 is provided at a single location along the axis A—A of the drum 10 for supporting the drum 10, the supporting arm 21 extending perpendicular to the axis A—A intermediate the end faces 18',20' of the body portions 18,20 respectively, of the drum 10. A power source 23 for rotation of the first body portion 18 is contained completely within the volume defined by the drum 10. The power source 23 preferably includes a rotary shaft 24 and means, shown generally at 26, for transferring rotation of the shaft 24 into rotation of the cutting surface 14, said means 26 including gear reduction means operatively connected to an interior portion of the cutting surface 14 and to the shaft 24.

According to an important feature of the present invention, it is possible to provide a continuous rotating cutting surface along the entire length of the cutting head 10 despite the fact that the body portions 18 and 20 are spaced a distance D. This is accomplished by providing means 28 for transferring rotation of the first body portion 18 into coincident rotation of the second body portion 20, the means 28 including a cutting chain 30 in operative association with both the body portions 18,20 and operatively bridging the space therebetween. It has been found that conventional cutting chains have the necessary properties for transmitting forces along the width thereof so that the transfer of the rotational forces of body 18 to body 20 is possible. The chain 30 may essentially be a conventional cutting chain having cutting projections 32 formed thereon, the only necessary change being in the provision of pairs of openings 36,38 on opposite portions of the chain 30 for cooperation with sprocket teeth 34,34' associated with the body portions 18,20, respectively. A sprocket 39 is provided remote from the cutting drum 10, mounted on the mining machine 13 as shown in FIG. 1, the sprocket having sprocket teeth 37,41 respectively for cooperation with the openings 36,38 in the chain 30 so that the chain 30 continuously rotates in conventional manner.

Figure 4:
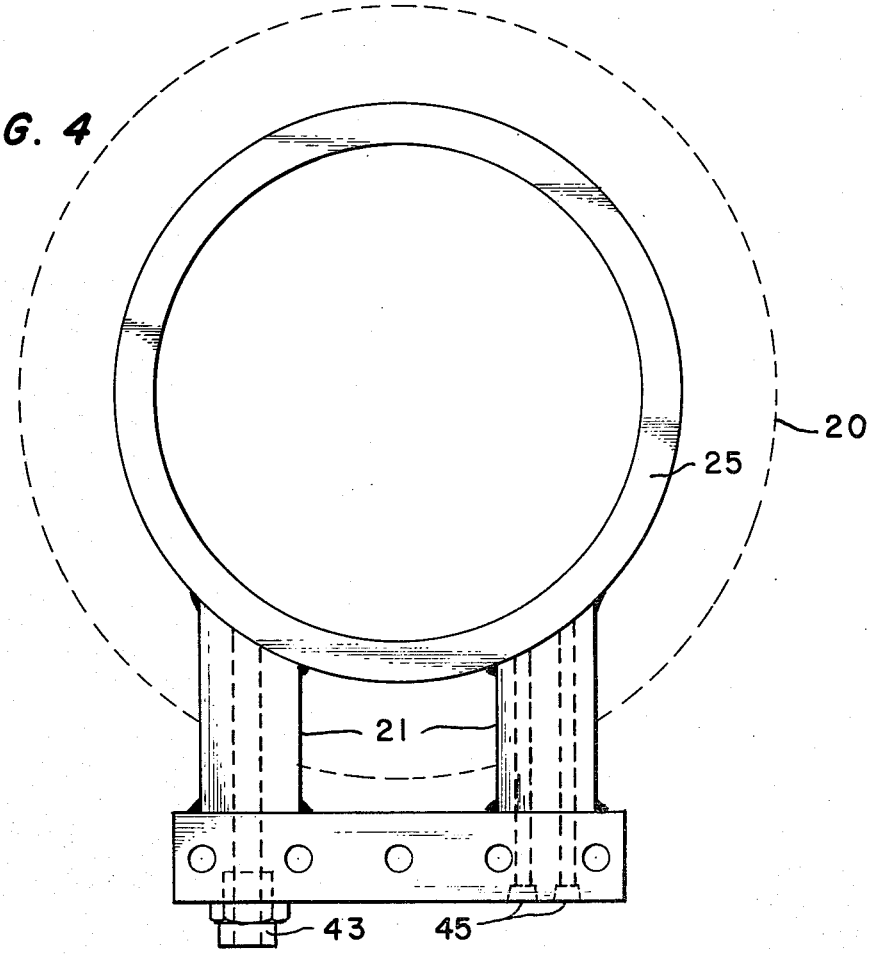
FIG. 4 is a top plan view of an exemplary cutting head according to the invention, with supporting arm.

The supporting arm 21 may have the configuration illustrated in FIG. 4, including a passageway 43 for passage of electric power cables from the machine 13 to the power source 23, and passageways 45 for transportation of cooling liquid into the interior of the drum 10 and into the power source 23. While the power source may be chosen from a wide variety of conventional power sources, it is preferred that it comprises an electric motor, such as a 75 hp. at 900 rpm, 440 V. A.C. water cooled motor. Such a motor is particularly suited for a mining machine environment, and is particularly utilizable with a 32 inch diameter drum 10, having a cutting speed of 630 ft./min. when a reduction gear ratio of 12 to 1 is utilized. A stationary casing 25 is provided for the motor 23, mounted to the arm 21, cooling passageways 47 (see FIG. 2) being formed in the casing 25 for receipt of the cooling liquid from passages 45. The motor 23 may include a stationary coil 49 operatively attached to the casing 25, and a rotor 51 operatively connected to the rotary shaft 24. Bearings **24*a* are provided at an intermediate location of the shaft 24 for allowing relative rotation between the shaft 24 and the casing 25. Additionally, a stationary member 53 is provided adjacent the end face 20' for journaling one end of the shaft 24, utilizing bearings 53*a*. Suitable conventional bearings 53*b* (such as Timken No. LL575349, LL575310) are provided for allowing relative rotation between the second body portion 20 and the stationary casing 25**.

The gear reduction means 26 preferably comprise a single stage planetary gear reduction means, although multiple stages are also useful. The reduction gearing means 26 includes a sun gear 52 formed on the shaft 24, a planet carrier 54, and a stationary ring housing 55. (See FIGS. 2 and 3 in particular.) The planet carrier 54 has a plurality of planetary gears 56 mounted thereon, each of the plurality of planetary gears being in operative association with the sun gear 52, and the planet carrier 54 operatively connected to the first body portion 18. The stationary ring housing 55 is operatively connected to the supporting arm 21 and is concentric with an interior of the first body portion 18. Gear means 57 are formed on the interior of the ring housing 55. The planetary gears 56 operatively engage the gear means 57 and the sun gear 52.

Figure 3:
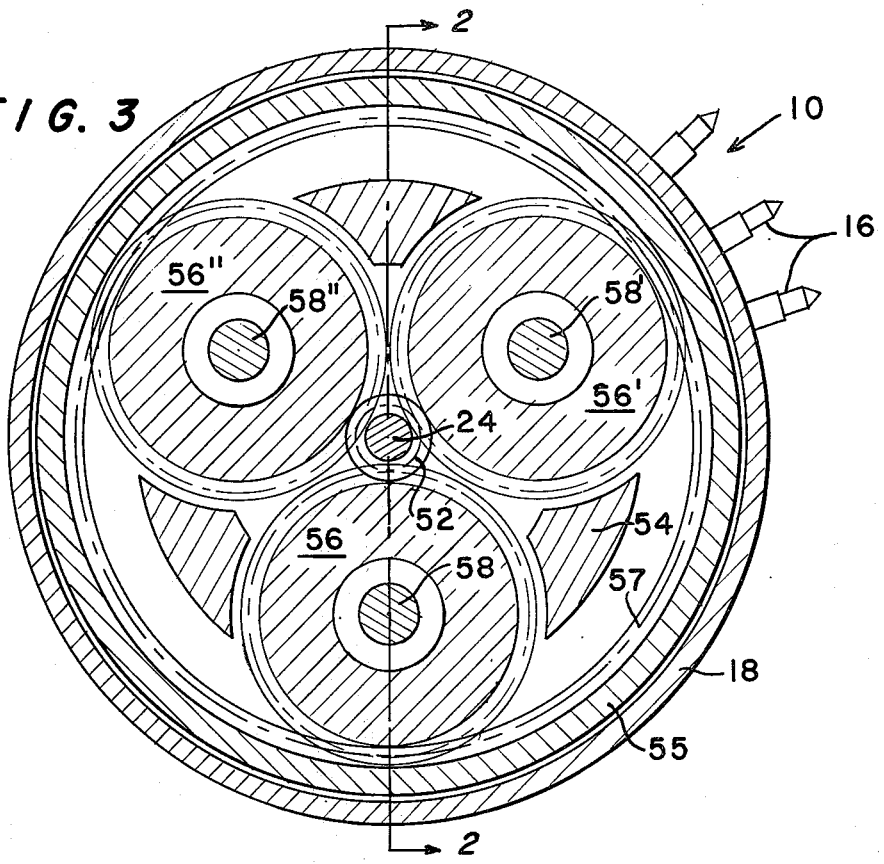
FIG. 3 is a cross-sectional view of an exemplary cutting drum taken along lines 3—3 of FIG. 2.

In order to provide a single stage of the planetary gearing yet achieve the desired reduction ratio (i.e. 12 to 1) it is preferred that three planetary gears 56,56', and 56" (see FIG. 3) be provided, each being substantially larger than the sun gear 52 so that gear surfaces of the gears 56,56',56" are adjacent the sun gear 52 substantially 360° around the circumference thereof (again see FIG. 3). With such large planetary gears 56,56',56", it is preferred that the planet carrier 54 have a portion 54' thereof above each gear 56, and a portion 54" thereof below each gear 56 (see FIG. 2), a shaft 58 extending between the portions 54',54" and mounting each gear for rotation (see FIGS. 2 and 3). The shaft 24 is journaled at the end thereof adjacent the sun gear 52 in the planet carrier 54, suitable bearings **54*a* being provided to allow relative rotation of the shaft 24 with respect to the planet carrier 54 since they will have a relative rotational speed of about 12 to 1. Bearings 57*a*,57*b* respectively, are provided between each portion 54',54" respectively of the planet carrier 54 and smooth walled portions 59,61 respectively of the ring housing 55 (see FIG. 2). Where only one planetary stage is utilized, the planet carrier 54 is directly connected to the first body portion 18, such as by bolts 60 (see FIG. 2) interconnecting interior portions of the end face 18' of the body portion 18 and the planet carrier 54**. Of course, other suitable connecting means may be provided.

Under some circumstances, it is desirable to have a cutting head 10 wherein the cutting height or width is adjustable—that is the swath along the axis A—A that is cut may be adjusted. This is especially so when the cutting drum 10 is to be utilized with a full face miner such as shown in U.S. Pat. No. 4,037,875. In such a case, the axis A—A will be generally vertical, the drum 10 having a normal height of, for instance, about 25 inches (see solid lines in FIG. 1), but being adjustable an extra distance, for instance 5 inches (see dotted line in FIG. 1) when a larger coal seam is encountered. Such adjustability is readily accommodated according to the present invention by forming the second body portion 20 out of two concentric tubular component portions 70,72 (see FIG. 1). The portion 70,71 are interconnected by spline means 74 so that they rotate together but are relatively reciprocal along the axis A—A with respect to each other. The inner component portion 70 preferably has the sprocket teeth 34' connected thereto and remains axially stationary, while the outer portion 72 has the cutting teeth 16 connected thereto and is axially movable with respect to the portion 70. Power means 75 are provided for selectively effecting the relative axial movement of the component portion 72. The power means 75 preferably includes a hydraulic cylinder, with hydraulic lines 77 leading through the supporting arm 21 to the cylinder 75. A piston shaft 79 is connected to the end plate 20' of the body portion 20 (component portion 72) by bearing means 79a to allow rotation of the body portion 20 while the hydraulic cylinder 75 remains stationary.

Operation

The apparatus according to the invention having been described, an exemplary operation thereof will now be set forth:

A cutting head 10 is assembled and disposed around a suitable power source 23, the stationary arm 21 connecting the power source 23 to a conventional mining machine 13. A chain 30 having spaced openings 36,38 in the length thereof is connected up to the sprocket teeth 34,34' of the drum body portions 18,20 respectively, and is disposed around a sprocket 39 in engagement with the sprocket teeth 37,41 thereof. Power and cooling lines (and hydraulic lines) are run through the supporting arm 21 to the motor 23. The mining machine 13 is moved into a coal seam or the like, and power is supplied to the motor 23, energization of the coils 49 resulting in rotation of the coils 51 and the shaft 24 attached thereto.

Sun gear 52 attached to the shaft 24 effects rotation of the planetary gears 56,56',56'', which also engage the gear means 57 of the ring gear 55 resulting in a much slower rotation of the planet carrier 54 than the shaft 24 (i.e. a reduction of 12 to 1). The planet carrier 54, being interconnected through bolt 60 and end plate 18' to the first body portion 18, effects rotation of the first body portion 18, the cutting teeth 16 thereof cutting coal from a seam or the like. Rotation of the first body portion 18 is transferred to the second body portion 20 via the cutting chain 30, so that the entire longitudinal extent of the cutting drum 10 has rotative cutting faces.

In situations where it is desirable to increase the cutting height or width, the cylinder 75 is energized resulting in relative movement of the component portions 72,70 of the second body portion 20 from the solid line position in FIG. 1 to the dotted line position in FIG. 1, rotation of the cutting teeth 16 being effected through the chain 30, and spline connection 74 between the component portions 70,72.

In conclusion, according to the present invention, a cutting drum having an internally mounted power source has been provided that requires only a single support arm, that presents a cutting face having rotatable cutting portions over the entire extent thereof, and which effects the necessary reduction between the power source and the cutting drum in a single planetary gear stage. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A generally cylindrical cutting drum for a mining machine or the like comprising first and second generally cylindrical body portions spaced from each other along the longitudinal axis of the drum cylinder, each of said body portions having cutting projections formed on the exterior surfaces thereof, a power source for rotating said first body portion, said power source contained completely with the cylinder of the cutting drum, and means for effecting rotation of the second body portion upon rotation of the first body portion, said means including a cutting chain, powered only by said source, in operative association with both said body portions and operatively bridging the space therebetween.

2. A drum as recited in claim 1 further comprising means for effecting operative association of said cutting chain and said body portions, said means comprising a plurality of sprocket teeth formed around the periphery of each of said body portions adjacent the other body portion, and openings formed in said cutting chain for receipt of said sprocket teeth.

3. A drum as recited in claim 2 further comprising a sprocket remote from said cutting drum having sprocket teeth thereof in operative engagement with said openings formed in said cutting chain.

4. A drum as recited in claim 2 wherein one of said body portions comprises a pair of component portions mounted for coincident rotational movement but relatively movable with respect to each other along said drum axis, and power means for moving said component portions with respect to each other, one of said component portions having said sprocket teeth associated therewith, and the other of said component portions relatively axially movable with respect to said one portion having sprocket teeth associated therewith, said one component remaining axially stationary.

5. A drum as recited in claim 4 further comprising spline means interconnecting said component portions of said body portion.

6. A drum as recited in claim 4 wherein said power means comprises a hydraulic cylinder and means for operatively connecting said cylinder to the axially movable component portion of said one body portion to allow relative rotational movement between said cylinder and said movable component portion while transmitting longitudinal axial movement of said cylinder to longitudinal axial movement of said component portion.

7. A drum as recited in claim 1 further comprising a single supporting arm extending from a mining machine for supporting said body portions, said supporting arm disposed in the space between said body portions, and said chain operatively covering said supporting arm.

8. A drum as recited in claim 7 wherein said supporting arm holds a casing for said power source stationary, said power source having a rotary shaft rotatable with respect to said casing and operatively connected to said first body portion by gear reduction means.

9. A drum as recited in claim 8 wherein said power source comprises an electric motor and wherein electrical power lines and lines for supplying cooling fluid to said motor extend through said supporting arm into the volume defined by said body portions.

10. A drum as recited in claim 1 wherein said power source comprises a rotary shaft and wherein said rotary shaft is operatively connected to said first body portion by planetary gear reduction means, said planetary gear reduction means comprising a sun gear formed on said rotary shaft, a planet carrier having a plurality of planetary gears mounted thereon, each of said plurality of planetary gears in operative association with said sun gear, and said planet carrier operatively connected to said first body portion, and a stationary ring housing concentric with said first body portion and interior thereof, gear means formed on the interior of said ring housing and said gear means in operative association with each of said planetary gears.

11. A drum as recited in claim 10 wherein said planetary gearing is single stage, said planet carrier connected directly to said first body portion, and wherein three planetary gears are provided in engagement with said sun gear, said three planetary gears being relatively large compared to said sun gear so that said sun gear has gear surfaces of said planetary gears disposed adjacent thereto substantially around the entire 360° circumference of said sun gear.

12. A drum as recited in claim 11 wherein said planet carrier has portions thereof disposed adjacent each face of each planetary gear, and wherein bearings are provided between each said portion of said planet carrier and smooth-walled portions of said ring housing.

13. A drum as recited in claim 10 wherein at one end thereof said shaft is journaled in said planet carrier, and at the other end thereof is journaled in a stationary member adjacent said second body portion.

14. A cutting drum for a mining machine or the like comprising a generally cylindrical cutting surface having cutting projections formed thereon, and having an axis of the cylinder and a pair of cylinder end faces, said cutting surface comprising two, first and second, discrete body portions, said body portions spaced from each other along the longitudinal axis of the cylinder;

a single supporting arm for said cutting drum, said supporting arm extending perpendicular to the axis of said cutting surface intermediate the end faces thereof, a power source for effecting rotation of said cylindrical cutting surface about said axis, said power source comprising a single motor disposed within the volume defined by said cylindrical cutting surface, and a motor shaft, said motor having portions thereof extending axially on either side of said single supporting arm, and means for transferring rotation of said motor shaft into rotation of said cutting surface, said means comprising gear reduction means operatively connected to an interior portion of said cutting surface and to said motor shaft, said interior portion comprising an interior portion of said first body portion; and said transferring means further comprising a cutter chain means, powered only by said source, interconnecting said first and second body portions.

15. A drum as recited in claim 14 further comprising means for effecting operative association of said cutting chain and said body portions, said means comprising a plurality of sprocket teeth formed around the periphery of each of said body portions adjacent the other body portion, and openings formed in said cutting chain for receipt of said sprocket teeth.

16. A drum as recited in claim 14 wherein said power source comprises an electric motor and wherein said single supporting arm holds a casing for said motor stationary.

17. A drum as recited in claim 16 wherein said casing includes passages for the transport of cooling fluid, and wherein electrical power lines and cooling fluid transporting lines extend through said supporting arm to said motor.

18. A drum as recited in claim 14 wherein said supporting arm is connected to a mining machine and wherein said supporting arm mounts said drum to said mining machine so that said cylinder axis is generally vertical, and wherein said supporting arm and drum attached thereto are horizontally reciprocal.

19. A drum as recited in claim 14 further comprising means for mounting a portion of said cutting surface for longitudinal axial movement with respect to said supporting arm and power means for moving said portion axially, said portion operatively spline connected to the rest of said cutting surface for coincident rotative movement therewith.

20. A drum as recited in claim 14 wherein said gear reduction means comprise a sun gear formed on said motor shaft, a planet carrier having a plurality of planetary gears mounted thereon, each of said plurality of planetary gears in operative association with said sun gear, and said planet carrier operatively connected to an end face of said cutting surface, a stationary ring housing concentric with said cutting surface and interior thereof, gear means formed on the interior of said ring housing and said gear means in operative association with each of said planetary gears.

21. A drum as recited in claim 20 wherein said planet carrier is connected directly to said cutting surface end face, and wherein three planetary gears are provided in engagement with said sun gear, said three planetary gears being relatively large compared to said sun gear so that said sun gear has gear sufaces of said planetary gears disposed adjacent thereto substantially around the entire 360° circumference thereof.

22. A drum as recited in claim 21 wherein said planet carrier has portions thereof disposed adjacent each face of each planetary gear, and wherein bearings are provided between each said portion of said planet carrier and smooth-walled portions of said ring housing.

23. A drum as recited in claim 14 wherein said gear reduction means comprises a single stage planetary reduction means.

* * * * *